US009982527B2

(12) United States Patent
Zhao et al.

(10) Patent No.: US 9,982,527 B2
(45) Date of Patent: May 29, 2018

(54) APPARATUS AND METHOD FOR A MATRIX ACOUSTIC ARRAY

(71) Applicant: GOWell International, LLC, Houston, TX (US)

(72) Inventors: Jinsong Zhao, Houston, TX (US); Qinshan Yang, Houston, TX (US)

(73) Assignee: GOWell International, LLC, Houston, TX (US)

( * ) Notice: Subject to any disclaimer, the term of this patent is extended or adjusted under 35 U.S.C. 154(b) by 337 days.

(21) Appl. No.: 14/788,112

(22) Filed: Jun. 30, 2015

(65) Prior Publication Data

US 2017/0002642 A1 Jan. 5, 2017

(51) Int. Cl.
*G01V 1/40* (2006.01)
*G01V 1/52* (2006.01)
*E21B 47/10* (2012.01)

(52) U.S. Cl.
CPC ..... *E21B 47/101* (2013.01)

(58) Field of Classification Search
CPC ... G01V 1/40; G01V 1/44; G01V 1/52; G01V 2001/526
USPC ..... 181/102; 367/25, 31
See application file for complete search history.

(56) References Cited

U.S. PATENT DOCUMENTS 3,542,150 A * 11/1970 Guy ..... G01S 1/72 181/104
4,641,724 A * 2/1987 Chow ..... G01V 1/44 181/104
4,805,156 A * 2/1989 Attali ..... E21B 47/0005 181/105
5,092,423 A * 3/1992 Petermann ..... E21B 17/1021 181/102
5,146,050 A * 9/1992 Strozeski ..... G01V 1/52 181/102
5,213,638 A 6/1993 Wright
5,831,934 A * 11/1998 Gill ..... G01V 1/48 367/25
5,874,676 A 2/1999 Maki, Jr.
5,909,666 A 6/1999 Gould et al.
5,996,711 A 12/1999 Ohmer
6,131,658 A * 10/2000 Minear ..... E21B 17/1028 166/250.01
6,510,389 B1 * 1/2003 Winkler ..... G01N 29/07 367/27

(Continued)

FOREIGN PATENT DOCUMENTS

WO 2014/169022 10/2014

OTHER PUBLICATIONS

International Search Report and Written Opinion for Application No. PCT/US16/39341 dated Nov. 7, 2016.

*Primary Examiner* — Kenneth L Thompson

(57) ABSTRACT

A device and method for wellbore inspection comprising a downhole tool. The downhole tool may comprise a wireline, a sensor cartridge, and a plurality of centralizers. The method for detecting defects within a wellbore may comprise inserting a downhole tool into a wellbore, wherein the downhole tool comprises a wireline, a sensor cartridge, and a plurality of centralizers. The method also includes producing an acoustic signal with the plurality of centralizers and recording the acoustic signal with a sensor, wherein the sensor records the acoustic signal within an aperture.

6 Claims, 7 Drawing Sheets

(56) References Cited

U.S. PATENT DOCUMENTS

| | | | | |
|---|---|---|---|---|
| 6,541,975 | B2 * | 4/2003 | Strack | G01V 11/00 181/102 |
| 7,133,326 | B2 * | 11/2006 | Kerfoot | G01S 15/8904 367/103 |
| 7,558,153 | B2 * | 7/2009 | Zeroug | G01V 1/44 367/27 |
| 7,675,814 | B2 * | 3/2010 | Mandal | G01V 1/44 181/105 |
| 7,885,142 | B2 * | 2/2011 | Tello | E21B 47/0005 181/105 |
| 8,096,355 | B2 * | 1/2012 | McDaniel | E21B 43/26 166/250.1 |
| 8,125,848 | B2 * | 2/2012 | Geerits | G01V 1/46 181/102 |
| 8,851,193 | B1 * | 10/2014 | Valerio | E21B 23/01 166/242.2 |
| 9,477,002 | B2 * | 10/2016 | Miller | E21B 33/124 |
| 2006/0062082 | A1 | 3/2006 | Mandal | |
| 2010/0157737 | A1 * | 6/2010 | Miller | E21B 33/124 367/117 |
| 2012/0033528 | A1 * | 2/2012 | Zhao | E21B 47/082 367/28 |
| 2014/0301164 | A1 | 10/2014 | Mandal | |
| 2015/0204993 | A1 * | 7/2015 | Leggett, III | E21B 47/01 367/7 |
| 2015/0331134 | A1 * | 11/2015 | Haldorsen | E21B 47/0005 367/35 |
| 2016/0032711 | A1 * | 2/2016 | Sheiretov | E21B 47/09 73/152.54 |
| 2016/0270763 | A1 * | 9/2016 | Hayes | A61B 8/54 |

* cited by examiner

APPARATUS AND METHOD FOR A MATRIX ACOUSTIC ARRAY

CROSS-REFERENCE TO RELATED APPLICATIONS

Not applicable

STATEMENT REGARDING FEDERALLY SPONSORED RESEARCH OR DEVELOPMENT

Not applicable.

BACKGROUND OF THE INVENTION

Field of the Invention

This invention relates to the field of detecting defects within a wellbore using non-destructive means.

Background of the Invention

Oil and gas drilling of a subterranean formation may require a wellbore to facilitate the removal of minerals, fluids, gases, and oils. Running deep below the surface, a wellbore may have to resist high temperatures and pressures exerted upon it from underground formations. Often, defects may form within the wellbore and lead to the loss of minerals, fluids, gases, and oils as they are transported to the surface through the wellbore. Precisely detecting defects within the wellbore may help personnel fix these defects.

Previous devices and methods that have been used to detect defects within a wellbore may not be able to detect smaller defects within a wellbore. Additionally, downhole tools used to detect leaks may not transmit data and information to the surface in real-time. Often, the downhole tools are removed from the wellbore before the data may be analyzed. The analyses of data in real-time may allow personnel to focus on specific areas of the wellbore with a downhole tool, which may provide additional information about the wellbore before removal of the downhole tool. In other examples, previous devices and methods may not have been able to detect azimuthal degrees and/or distance of the defect from the center of the wellbore. The azimuthal degree and distance of the defect from the center of the wellbore may provide information to produce a radial profile of distribution of defects within a wellbore. A radial profile may be used to prevent any leakage or the wellbore and/or may help locate an acoustic noise source produced by a defect. This may prevent the reinsertion of the downhole tool multiple times within the wellbore, saving time and expense.

There is a need for a downhole tool which may be used to detect defects continuously within a wellbore, transmit large amounts of data to the surface in real-time, and increase working efficiency.

BRIEF SUMMARY OF SOME OF THE PREFERRED EMBODIMENTS

These and other needs in the art may be addressed in embodiments by a device and method comprising a wellbore inspection downhole tool. The downhole tool may comprise a wireline, a sensor cartridge, and a plurality of centralizers. The method for detecting defects within a wellbore may comprise inserting a downhole tool into a wellbore, wherein the downhole tool comprises a wireline, a sensor cartridge, and a plurality of centralizers. The method further includes producing an acoustic signal with the plurality of centralizers and recording the acoustic signal with a sensor, wherein the sensor records the acoustic signal within an aperture.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

The present disclosure relates to embodiments of a device and method for inspecting a wellbore for defects. More particularly, embodiments of a device and method are disclosed for recording acoustical noise within a wellbore to determine the location of a defect within a wellbore. In embodiments, a downhole tool may be inserted into a wellbore using wireline technology. Within the wellbore, the downhole tool may produce vibrations along the wellbore wall using centralizers disposed on the outside of the downhole tool. Vibrations produced along the wellbore wall may create acoustic noise, which may be recorded by the downhole tool.

A sensor cartridge within the downhole tool may use any combination of sensors in which to detect acoustical noise within the wellbore. Acoustical noise may comprise signal waves which may be accomplished by sensors with a sensor cartridge. The signal wave data may be recorded, compiled, and analyzed to determine the location of defects within the wellbore wall. Determination of defects, detection of defects and/or transmission of data to the surface may be accomplished in real-time and may be performed as the downhole tool moves through the wellbore. In embodiments, the downhole tool may be removed from the wellbore before the recorded signal wave data may be compiled and analyzed.

Figure 1:
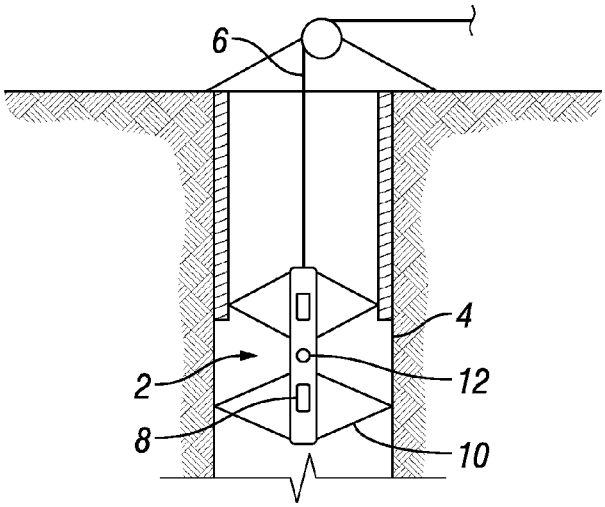
FIG. 1 illustrates an embodiment of a downhole tool disposed in a wellbore.

As illustrated in FIG. 1, a downhole tool 2 may be lowered into a wellbore 4 by a wireline 6. In other embodiments, downhole tool 2 may be lowered into wellbore 4 by coiled tubing or any other suitable means, not illustrated. Downhole tool 2 may comprise a sensor cartridge 8, centralizers 10, and memory unit 12. Downhole tool 2 may also include any other desired components. In embodiments, there may be a plurality of sensor cartridges 8 disposed within downhole tool 2 at any suitable location. In embodiments, downhole tool 2 may be made of any suitable material to resist corrosion and/or deterioration from a fluid or conditions within wellbore 4. Suitable material may be, but is not limited to, titanium, stainless steel, plastic, and/or any combination thereof. Downhole tool 2 may be any suitable length and width in which to properly house components within downhole tool 2. A suitable length may be about one foot to about ten feet, about four feet to about eight feet, about five feet to about eight feet, or about three feet to about six feet. Additionally, downhole tool 2 may have any suitable width. A suitable width may be about one foot to about three feet, about one inch to about three inches, about three inches to about six inches, about four inches to about eight inches, about six inches to about one foot, or about six inches to about two feet.

Figure 6:
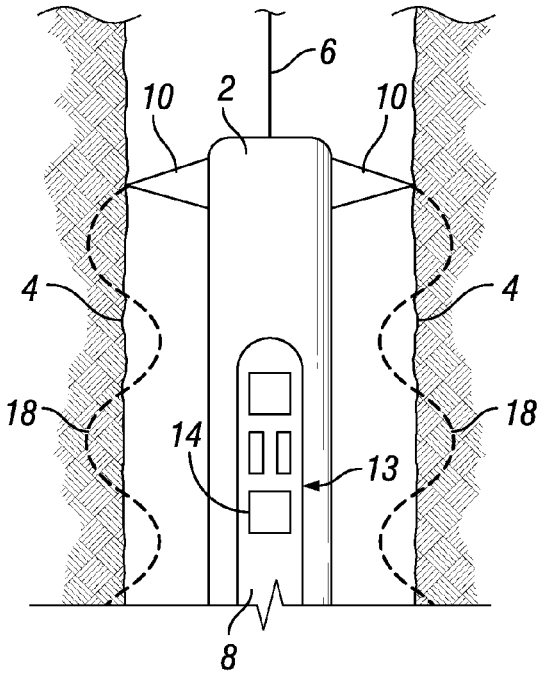
FIG. 6 illustrates an embodiment of a downhole tool disposed in a wellbore and a signal wave traveling down the wellbore.

Centralizers 10 may prevent downhole tool 2 from physically contacting wellbore 4, such as by running into, hitting, and/or rubbing up against wellbore 4. Additionally, centralizers 10 may be used to keep downhole tool 2 properly oriented within wellbore 4. In embodiments, centralizers 10 may produce acoustic noise along wellbore 4. The acoustic noise may comprise of vibrations, wherein, as shown in FIG. 6, the vibrations further comprise a signal wave 18 and/or a plurality of signal waves 18. Signal wave 18 may be recorded by sensors 13 located within sensor cartridges 8. In embodiments, there may be a plurality of centralizers 10. Centralizers 10 may be located at any suitable location along downhole tool 2. A suitable location may be about an end of downhole tool 2, about the center, and/or between the center and an end of downhole tool 2. In embodiments as illustrated, a centralizer 10 may be disposed at about opposing ends of downhole tool 2. Centralizers 10 may be made of any suitable material. Suitable material may be but is not limited to, stainless steel, titanium, metal, plastic, rubber, neoprene, or any combination thereof.

As downhole tool 2 moves through wellbore 4, it may record acoustic noise created such as from fluid leaking through or behind a casing, flowing fluid channel noise, sand jet entry into a wellbore 4, perforation production, and fluid filtration within a formation. Acoustic noise properties may be recorded and analyzed. Specific properties recorded and analyzed may be frequency, amplitude, acoustic mode (compress, shear, etc.), propagation direction, velocity, location azimuthal, and distribution of the noise from a source point. This information may be stored on a memory unit 12, as illustrated in FIG. 1, which may provide in tool memory and may comprise flash chips and/or ram chips which may be used to store data and/or buffer data communication. Stored data may be transferred to the surface in real-time through wireline 6 to the surface. In embodiments, data may be transferred as downhole tool 2 is moving through wellbore 4 and/or while downhole tool 2 is in a fixed position. In embodiments, data may be stored on memory unit 12 until downhole tool 2 has been removed from wellbore 4.

Figure 2A:
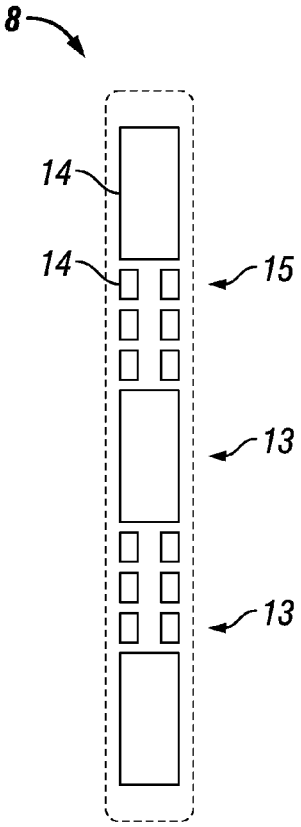
FIG. 2A illustrates an embodiment of a sensor cartridge and sensor body.
Figure 2B:
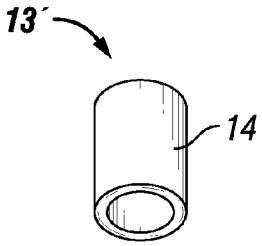
FIG. 2B illustrates an embodiment of a sensor.
Figure 2C:
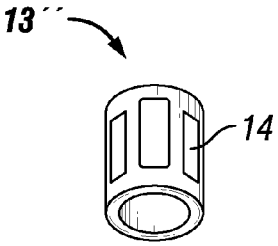
FIG. 2C illustrates an embodiment of a sensor.
Figure 3:
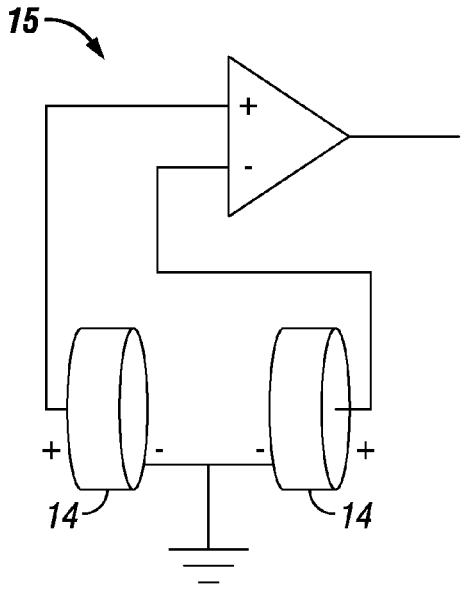
FIG. 3 illustrates a schematic of a sensor setup.

Sensor cartridge 8, as illustrated in FIG. 2, may be disposed at any location within downhole tool 2. In embodiments, there may be a plurality of sensor cartridges 8 within downhole tool 2. Sensor cartridge 8 may comprise any type and any number of sensors 13 suitable for detecting acoustic noise. Suitable sensors 13 may include, but are not limited to, monopoles, dipoles, and/or quadrupoles. In embodiments, sensors 13 may be defined as monopole, dipole, and/or quadrupoles based upon the number of sensor surfaces 14 that are connected. Sensor surfaces 14 may be comprised of any suitable material such as piezoceramic material, ferroelectric, lead titanate, lead zirconate, lead metaniobate, or any combination thereof. In embodiments, sensor surface 14 includes piezoceramic material. Piezoceramic material may be used to record noise generated within a wellbore 4. As illustrated in FIG. 3, a dipole sensor 15 may have two sensor surfaces 14 which may be connected. In a dipole configuration, data is recorded from opposite directions and compared against each other. Referring back to FIG. 2, a sensor cartridge 8 may have a plurality of different sensors, arranged in any order. The arrangement of sensors may allow for downhole tool 2 to search for defects within wellbore 4 walls. As illustrated in FIG. 2, sensor 13 may include different sensors such as a monopole sensor 13' and quadrupole sensor 13".

Figure 4:
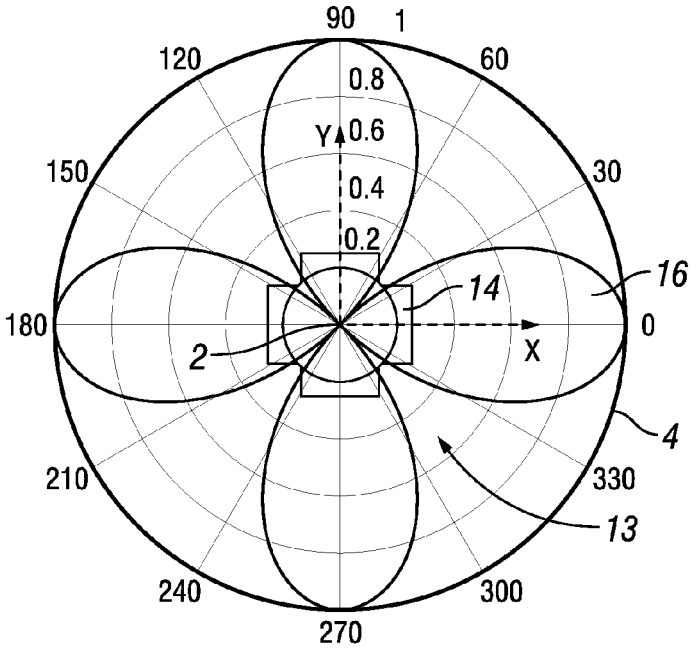
FIG. 4 illustrates an embodiment of sensors and their aperture areas.
Figure 5A:
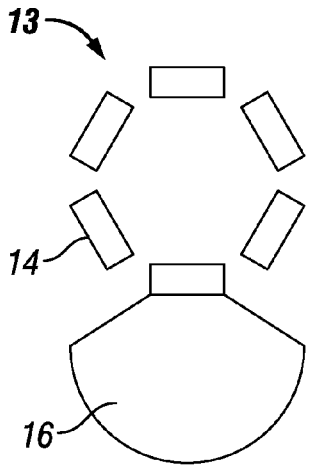
FIG. 5*a* illustrates an embodiment of a sensor surface and its aperture area.
Figure 5B:
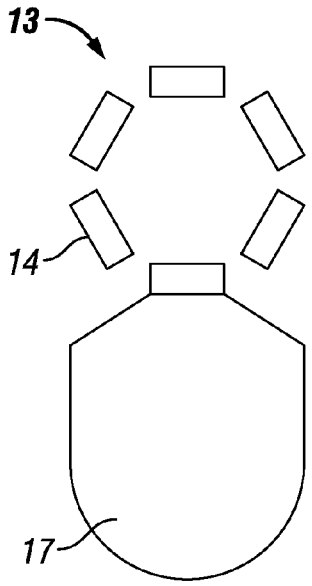
FIG. 5*b* illustrates an embodiment of three sensor surfaces combining their aperture area using a phased control.

FIG. 4 illustrates a top down view of downhole tool 2 within a wellbore 4. Apertures 16 may indicate an area in which a sensor 13 records acoustical sounds. As illustrated, downhole tool 2 may comprise two dipole sensors, four monopole sensors, or one dipole and two monopole sensors. Each setup may have four sensors 13 set to record acoustic noise in four different directions. In embodiments, sensors 13 may comprise six to twelve, eight to ten, six to ten, or eight to twelve sensor surfaces 14. Each sensor surface 14 may record within different apertures 16. In embodiments, recordings from sensor surface 14 may be combined to produce a larger aperture 17. Larger aperture 17 may be produced using a phased control method. FIG. 5*a* illustrates aperture 16 within which a single sensor surface 14 may record and measure acoustic noise. FIG. 5*b* illustrates larger aperture 17, which may be created from the combination of three sensor surfaces 14. Larger aperture 17 may allow sensor surface 14 to accurately record and measure in more detail acoustic noise further away. A phase control method may be used to create larger aperture 17. The phase control equation, as disclosed below:

$$P_a(\phi) = \sum_{i=1}^{N} w_i e^{j(k_0(i-1)d\sin(\phi)+\theta_i)}$$

may be defined where $w_i$ and $\theta_i$ may be weighted factors and where phased adjustments may be performed at an i-th component. Additionally, d may be the distance between different sensors, k may be the wavenumber, N may be the number of sensors, and j is an imaginary unit. In embodiments, d may be optimized when with the equation below:

$$d < \frac{\lambda}{2}$$

where λ may be the wavelength of signal wave 18.

As illustrated in FIG. 6, downhole tool 2 may move through wellbore 4 at any known velocity, attached to wireline 6. Centralizers 10 may keep downhole tool 2 oriented within wellbore 4. Keeping downhole tool 2 properly oriented may include centralizers 10 to remain in about constant contact with the walls of wellbore 4. While in contact with wellbore 4, centralizers 10 may produce "road noise." Road noise may refer to the acoustical sound of centralizers 10 rubbing against wellbore 4, wireline 6 rubbing against wellbore 4, and/or any noise generated by the continuous movement of downhole tool 2 through wellbore 4. The acoustical sound may produce a signal wave 18. In embodiments, signal wave 18 may be nearly the same at each point centralizers 10 contact wellbore 4 and remain nearly the same as signal wave 18 propagates through the walls in wellbore 4.

As signal wave 18 propagates through wellbore 4, it may come into contact with defects within wellbore 4. These defects may reflect and/or alter signal wave 18, creating a defect signal wave 19. The defect signal wave 19 may have a different frequency, amplitude, acoustic mode (compress, shear, etc.), propagation direction, velocity, location azimuthal, and/or distribution of the noise from a source point separate and apart from signal wave 18. In embodiments, defect signal wave 19 may also be produced from centralizers 10 coming into contact with a defect. Defect signal wave 19 may be recorded by sensors 13. In order to prevent defect single wave 19 from becoming lost in all the data recorded, a method of filtering the signals may be employed to remove road noise from the acoustical noise created by a defect.

Referring to FIG. 6, road noise may produce signal wave 18 which may propagate through wellbore 4. As illustrated in FIG. 4, sensor surfaces 14 may view signal wave 18 within an x and y coordinate system. One sensor surface 14 may record signal wave 18 in a positive x and/or y direction, and an opposing sensor surface 14 may record signal wave 18 in a negative x and/or y direction. Therefore, one sensor surface 14 may view signal wave 18 in a negative direction, and an opposing sensor surface 14 may view signal wave 18 in a positive direction. Thus, because signal wave 18 may be nearly identical in properties across wellbore 4, comparing recorded signal wave 18 from two opposing sensor surfaces 14 may cancel out signal wave 18, removing road noise, through destructive interference. A defect signal wave 19 may not be susceptible to destructive interference because there may not be identical defects to produce a defect signal wave 19 with nearly the same signal properties.

Figure 7:
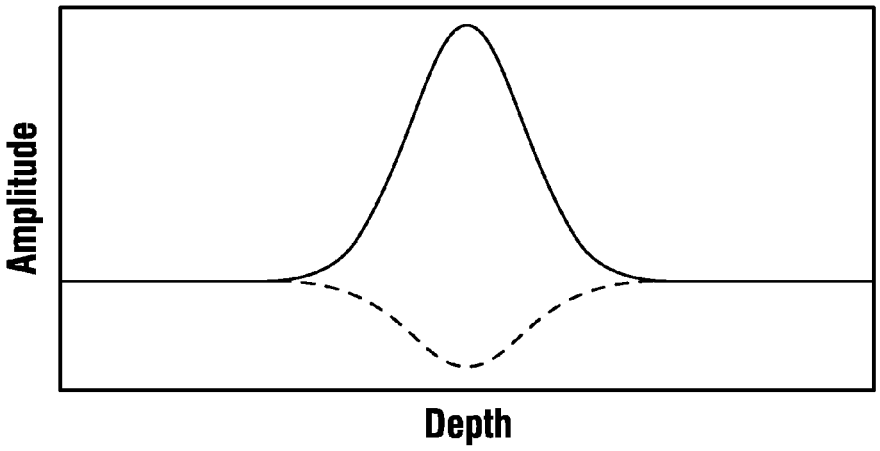
FIG. 7 illustrates a graph of sensors recording when passing a defect within a wellbore.

FIG. 7 illustrates a graph that may be produced as a sensor 13 records acoustical noise, moving past a defect within wellbore 4. As sensor 13 begins moving through wellbore 4, sensor 13 may not be able to detect a defect signal wave 19 due to signal dissipation and/or no defects may be present in wellbore 4. Therefore, sensor surface 14 may only record road noise. As described above, road noise may be nearly identical across wellbore 4, however it is not perfectly identical. Thus, while most road noise may be removed, sensor 13 may still provide data for a plot on a graph signal wave 18 with a reduced amplitude. This may be illustrated as a steady line moving left to right across the illustrated graph in FIG. 7, wherein the y-axis is the height of the amplitude and the x-axis indicates the depth from the surface. As downhole tool 2 moves through wellbore 4, sensor 13 may move past a defect within wellbore 4. Sensors 13 may then begin to record a defect signal wave 19. At this point, road noise may no longer be produced due to the defect within wellbore 4. Road noise may begin to dip, moving toward zero, along the y-axis. The defect signal wave 19, forming a second line of plotted points, may begin to increase in amplitude and move away from zero along the y-axis. The divergence of these two lines may signal to an operator the location and depth of a defect within wellbore 4. As sensors 13 move away from the defect, road noise may increase and the defect signal wave 19 may begin to dissipate, attenuate, and/or not be recorded by sensors 13. This may be graphed as the two separately plotted lines merging back into a singular plotted line comprising mostly of road noise.

Figure 8A:
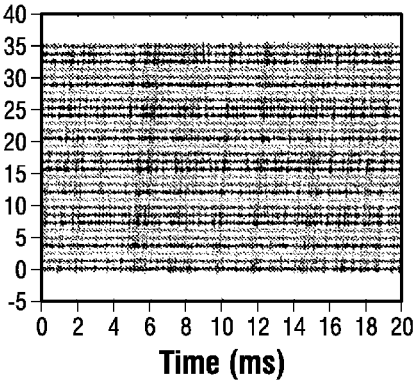
FIG. 8*a* illustrates a graph of all recorded acoustical noise by a sensor cartridge.
Figure 8B:
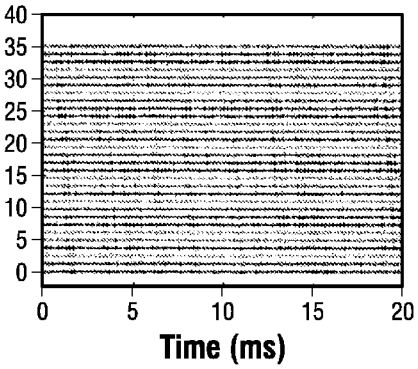
FIG. 8*b* illustrates a graph of recorded acoustical noise of down-propagation waves.
Figure 8C:
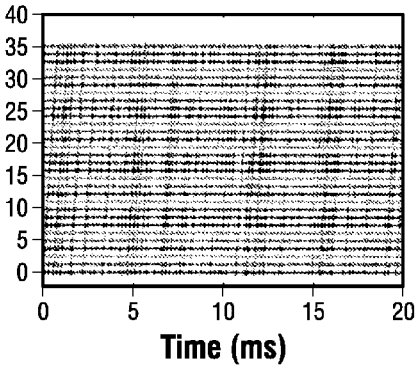
FIG. 8*c* illustrates a graph of recorded acoustical noise of the up-propagation waves.
Figure 9:
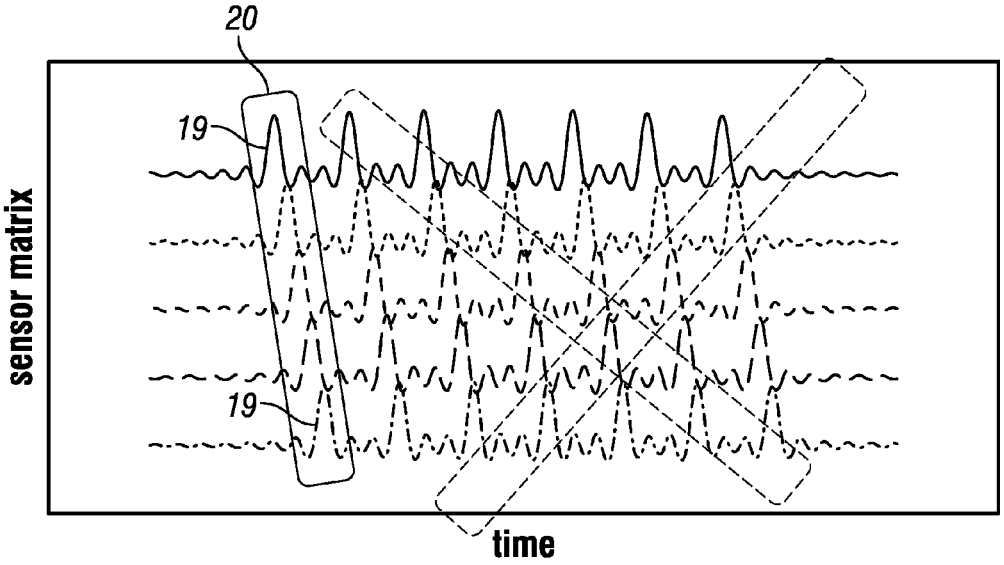
FIG. 9 illustrates a graph of recorded defect signal waves.

FIG. 8*a* illustrates an embodiment of all recorded acoustical noise, in signal form, as downhole tool 2 moves down and up wellbore 4. Filters may separate the data into down-propagation wave results, as illustrated in FIG. 8*b*, and up-propagation wave results, as illustrated in FIG. 8*c*. A suitable filter may be used such as a frequency wavenumber filter, time space filter, radon filter, median filter, and/or the like. Each individual line moving along the x-axis may represent the recordings of sensor 13. As illustrated in FIG. 9, these plotted lines may be used to help determine the location of a defect within wellbore 4. Individual sensors 13 may be disposed above and below each other, which may detect a defect at different times. Determining the time at which every sensor surface 14 may record a defect signal wave 19 may help filter out any additionally recorded noises which may not have been removed from destructive interference.

Within downhole tool 2, an accelerometer and gyroscope, not illustrated, may be positioned within downhole tool 2 to help determine the speed and orientation of downhole tool 2 as it moves throughout wellbore 4. It is to be understood that speed and orientation may be determined by any suitable means. In embodiments, velocity may also be determined by the detection of acoustic noise generated when centralizers 10 come into contact with wellbore collars, not illustrated. Wellbore collars may be devices used to seal joints between two different sections of wellbore 4. The length of these sections may be known and recorded during drilling. Velocity may be determined by using a known length and time to detect acoustic noise generated by different wellbore collars. Determining the velocity may allow for the identification of depth and time when a defect at each sensor 13 may be recorded. As illustrated in FIG. 9, a velocity box 20 may be drawn around defect signal waves 19, which may illustrate the depth and time at which a sensor 13 passed a defect within wellbore 4. This may help in distinguishing between pluralities of defects within wellbore 4.

Figure 10A:
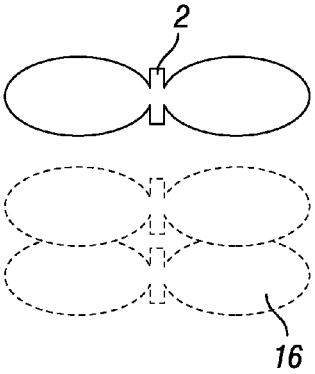
FIG. 10*a* illustrates an embodiment of a downhole tool recording measurements within apertures as to movement through a wellbore.
Figure 10B:
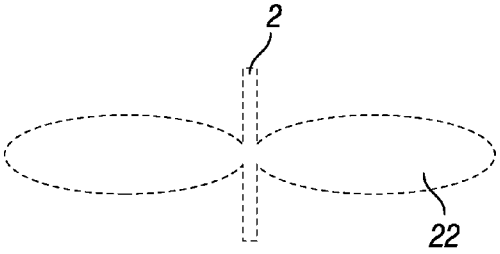
FIG. 10*b* illustrates an embodiment of a synthetic aperture.
Figure 11:
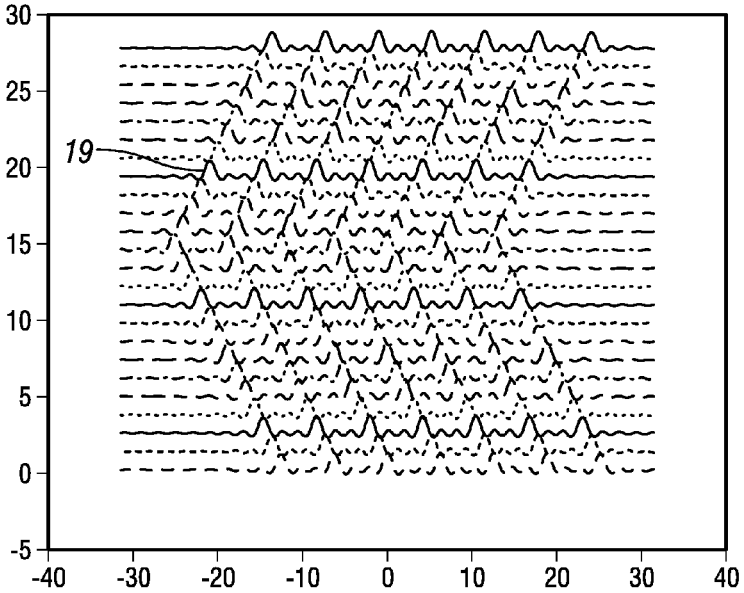
FIG. 11 illustrates a graph plotting defect signal waves from a synthetic aperture.

In embodiments, a synthetic aperture 22 may be produced based off the recorded data from individual sensor surfaces 14. Synthetic aperture 22 may take multiple recordings of sensors 13 at different depths and produce a graph illustrating a single recorded signal wave 18 and/or defect signal wave 19 at any given depth. As illustrated in FIG. 10*a*, a series of apertures 16 may be recorded continuously as downhole tool 2 moves through wellbore 4. The distance between a centralizer 10 and sensor 13 may be known and constant. This may allow for creation of a synthetic aperture 22, illustrated in FIG. 10*b*. As illustrated in FIG. 10*b*, synthetic aperture 22 may combine multiple apertures 16 into a larger synthetic aperture 22. This may increase resolution and depth within the recorded data. A graph, as illustrated in FIG. 11 may then be produced from the recorded data. The graph may improve illustration of the location of defects within wellbore 4. Synthetic aperture 22 may combine multiple apertures 16 using a Hilbert transform, wherein the Hilbert transform may calculate the phase shift between different time frames. A Hilbert transform is disclosed below:

$$\hat{s}(t) = \mathcal{H}\{s\} = h(t) * s(t) = \int_{-\infty}^{\infty} s(\tau)h(t-\tau)\,d\tau = \frac{1}{\pi}\int_{-\infty}^{\infty} \frac{s(\tau)}{t-\tau}\,d\tau$$

where $$h(t) = \frac{1}{\pi t}$$

Additionally, S(t) may be the measurement signal in the time domain. The Hilbert transform may be a convolution between time domain signal S(t) and impulse response of the system h(t). Where t is the time index, and T is the convolution operator. In order to create a synthetic aperture 22, aperture 16 measurements at different depth position may be combine together, which may produce a larger measurement area than the original apertures 16. A possible mathematical expression of synthetic aperture 22 may be as follows:

$$S = \begin{bmatrix} f(M_1) \\ \vdots \\ f(M_N) \end{bmatrix}$$

wherein S is the synthetic aperture 22 measurements. $M_1$ to $M_N$ are the aperture 16 measurements at different positions and depths. Additionally, f( ) represents the Hilbert transform that is used to shift the phase of each measurement.

Although the present invention and its advantages have been described in detail, it should be understood that various changes, substitutions and alterations may be made herein without departing from the spirit and scope of the invention as defined by the appended claims.

What is claimed is:

1. A wellbore inspection downhole tool, comprising:

a wireline;

a sensor cartridge, wherein the sensor cartridge further comprises at least one sensor, wherein the at least one sensor is a monopole, dipole, or quadrupole, wherein the at least one sensor comprises at least one sensor surface, wherein the at least one sensor surface records acoustic noise within an aperture, wherein apertures for at least one sensor surface are combined into a larger aperture; and a plurality of centralizers.

2. The wellbore inspection downhole tool of claim 1, wherein apertures for at least one sensor surface are combined into a synthetic aperture.

3. The wellbore inspection downhole tool of claim 1, further comprising a gyroscope.

4. A method for detecting defects within a wellbore, comprising:

(A) inserting a downhole tool into a wellbore, wherein the downhole tool comprises a wireline, a sensor cartridge, and a plurality of centralizers;

(B) producing an acoustic signal with the plurality of centralizers;

(C) recording the acoustic signal with a sensor, wherein the sensor records the acoustic signal within an aperture; and (D) transmitting the recorded acoustic signals to personnel through the wireline in real-time, wherein transmitting the recorded acoustic signal is accomplished when the downhole tool is moving.

5. A method for detecting defects within a wellbore, comprising:

(A) inserting a downhole tool into a wellbore, wherein the downhole tool comprises a wireline, a sensor cartridge, and a plurality of centralizers;

(B) producing an acoustic signal with the plurality of centralizers;

(C) recording the acoustic signal with a sensor, wherein the sensor records the acoustic signal within an aperture; and (D) combining apertures into a larger aperture, wherein the combination is performed using a phase control.

6. A method for detecting defects within a wellbore, comprising:

(A) inserting a downhole tool into a wellbore, wherein the downhole tool comprises a wireline, a sensor cartridge, and a plurality of centralizers;

(B) producing an acoustic signal with the plurality of centralizers;

(C) recording the acoustic signal with a sensor, wherein the sensor records the acoustic signal within an aperture; and (D) combining apertures into a synthetic aperture, wherein the combination is performed using a Hilbert transform.

* * * * *